US006114932A

United States Patent [19]

Wester et al.

[11] Patent Number: 6,114,932

[45] Date of Patent: Sep. 5, 2000

[54] INDUCTIVE COMPONENT AND INDUCTIVE COMPONENT ASSEMBLY

[75] Inventors: Henrik Wester, Stockholm; Per Ferm, Taby; Jan Öhrn, Upp Vasby, all of Sweden

[73] Assignee: Telefonaktiebolaget LM Ericsson, Stockholm, Sweden

[21] Appl. No.: 08/990,005

[22] Filed: Dec. 12, 1997

[51] Int. Cl.[7] ..... H01F 27/06; H01F 27/29; H01F 27/30

[52] U.S. Cl. ..... 336/65; 336/83; 336/192; 336/200; 336/223

[58] Field of Search ..... 336/65, 68, 83, 336/200, 232, 223, 192

[56] References Cited

U.S. PATENT DOCUMENTS

| | | | |
|---|---|---|---|
| 3,332,049 | 7/1967 | Hisano | 336/83 |
| 3,555,464 | 1/1971 | Maeda et al. | 336/65 |
| 4,622,627 | 11/1986 | Rodriguez et al. . | |
| 4,833,437 | 5/1989 | Williamson | 336/83 |
| 4,939,623 | 7/1990 | Equi et al. | 336/65 |
| 4,943,793 | 7/1990 | Ngo et al. | 336/83 |
| 5,010,314 | 4/1991 | Estrov . | |
| 5,017,902 | 5/1991 | Yerman et al. | 336/200 |
| 5,175,525 | 12/1992 | Smith | 336/232 |
| 5,179,365 | 1/1993 | Raggi | 336/65 |
| 5,321,380 | 6/1994 | Godek et al. . | |
| 5,386,206 | 1/1995 | Iwatani et al. . | |
| 5,420,558 | 5/1995 | Ito et al. . | |
| 5,430,424 | 7/1995 | Sato et al. . | |
| 5,497,137 | 3/1996 | Fujiki . | |
| 5,559,487 | 9/1996 | Butcher et al. | 336/83 |
| 5,565,837 | 10/1996 | Godek et al. . | |
| 5,572,179 | 11/1996 | Ito et al. . | |
| 5,583,424 | 12/1996 | Sato et al. . | |
| 5,598,327 | 1/1997 | Somerville et al. . | |
| 5,684,445 | 11/1997 | Kobayashi et al. | 336/232 |

FOREIGN PATENT DOCUMENTS

| | | |
|---|---|---|
| 0267108A1 | 5/1988 | European Pat. Off. . |
| 2471033 | 12/1981 | France . |
| 3700488A1 | 7/1988 | Germany . |
| 4007614A1 | 9/1990 | Germany . |
| 63-54703 | 3/1988 | Japan . |
| 689814 | 3/1994 | Japan . |
| 6151207 | 5/1994 | Japan . |
| 6215962 | 8/1994 | Japan . |
| 6310347 | 11/1994 | Japan . |
| 7211548 | 8/1995 | Japan . |
| 7230913 | 8/1995 | Japan . |
| 8316040 | 11/1996 | Japan . |
| 875480 | 10/1981 | U.S.S.R. . |

*Primary Examiner*—Thomas J. Kozma

[57] ABSTRACT

An inductive component including a primary coil having first and second terminals, and a secondary coil including a coil substrate, wiring patterns, and conductive terminals. The coil substrate is provided with alignment recesses for receiving and locating the first and second terminals of the primary coil in a fixed relationship to each other and to the conductive terminals of the secondary coil and an inductive component assembly having the inductive component is mounted outside a periphery of a substrate. A magnetic core of the inductive component has a central portion which is displaced off an edge of the magnetic core and has bevelled edges at a base of the central portion of the magnetic core. Terminals of both the primary coil and the secondary coil are located close together on the same side of the inductive component to reduce thermal stress.

21 Claims, 4 Drawing Sheets

INDUCTIVE COMPONENT AND INDUCTIVE COMPONENT ASSEMBLY

FIELD OF THE INVENTION

The present application is generally directed to an inductive component and an inductive component assembly. More particularly, the present invention is directed to an inductive component and inductive component assembly utilized in a power supply.

BACKGROUND OF THE INVENTION

Inductors, transformers and other inductive components are commonly utilized in a wide variety of electronic circuitry, including in power supplies or DC/DC converters used to drive various electronic circuits, as illustrated in German Patent Publication DE 3,700,488 published Jul. 21, 1988. As time passes, there is a continued object to decrease both the cost and size of such electronic circuits. There is therefor a continuing objective to decrease the size and to increase the efficiency of such inductive components.

An important inductive component parameter is its height profile and it is a goal of inductive component designers to minimize this height profile. However, utilizing conventional techniques, it is difficult to decrease inductor size and still maintain the same component performance level. The total height of a circuit assembly including a circuit board or other substrate and the circuit components mounted thereon including the inductive component or components should be minimized to reduce total assembly height, desirably reducing overall assembly height.

Various types of inductors or inductive components are known and used in electronics. Each of these inductor types exhibits advantages and disadvantages. One type of known inductive component utilizes coated round copper wire for primary and any secondary windings. Since the round wire, when wound, has substantial air spaces in the windings and since these air spaces vary with how the wire is wound and with the tension of the wire, etc., these coated round wire inductive components are difficult to mass produce. Further, the air spaces between the windings reduce winding efficiency causing the inductive component to be relatively large for a given inductance.

A second type of inductive component proposes to employ an inductive winding formed of flat coated copper wire. Such an inductor or component can create a larger inductance value at a given current than a round wire inductor due to the increased conductor density caused by the elimination of much of the air space present between the coil windings of a round wire inductor. Accordingly, for a given inductance and current capacity, an inductive component formed of flat wire may have a lower height profile and handle a higher current due to the low resistance in the flat wire and its increased density. An example of such a flat wire inductive component is described in (German Patent Publication DE 4,007,614 published Sep. 13, 1990.

It has also been proposed to form inductive windings on printed circuit boards. Such a winding is formed as a conductive pattern using conventional printed circuit board manufacturing techniques. However, the printed circuit board is comprised mostly of insulation material which means that the copper printed windings must be small and the DC resistance of the winding is high, preventing the use of such coils in high current applications.

Despite past advances, there is a need for an inductive component for use in a power supply which has a high current primary winding usable for applications such as high current smoothing and a secondary winding, having an output current utilized to monitor the current and/or voltage in the primary winding and provide a supply voltage or information feedback to a control or other circuit connected thereto, without galvanic contact. There is also a need for an inductive component that can be mass produced easily and cheaply and that has increased performance.

SUMMARY OF THE INVENTION

The inductive component and inductive component assembly of the present invention solve the above-identified problems with conventional inductive components by providing an inductive component with an extremely flat profile, good heat transfer from the inductive component to an underlying support, has high current capacity, and is inexpensive and easy to manufacture.

Manufacturing efficiency is enhanced, in accordance with the teachings of the present application, by using recesses provided in the substrate of a printed circuit board secondary winding to accomplish alignment of the primary winding, enabling the primary winding to be more easily fixed to a printed circuit board or circuit supporting ceramic substrate.

The alignment recesses receive and locate the first and second terminals of the primary coil in a fixed relationship to each other and to the conductive terminals of the secondary coil. These alignment recesses reduce thermal stress and distortion of the wiring of the primary coil during soldering.

The use of a flat primary winding surrounded by a magnetic core enables the inductive component to be manufactured with a relatively low component height. In order to further reduce the height of a circuit assembly including the inductive component, the inductive component is provided terminals which are affixed to the substrate so that the inductive component is mounted outside the periphery of the substrate. In this fashion, the total assembly height is reduced by the thickness of the substrate since the inductive component can use this additional height.

The inductive component and the circuit supporting substrate are desirably affixed to a support which may be an electrically conductive or non-conductive case or other support. Desirably, the support is thermally conductive and will dissipate thermal buildup from the inductive component. Since the circuitry supporting substrate is not interposed between the inductive component and the support, a more direct thermal path is provided enhancing thermal transfer efficiency.

It is an object of the present invention to provide an inductive component assembly which increases thermal transfer between the inductive component and the support on which it is mounted and enables the entire assembly to be easily manufactured. The inductive component assembly of the present invention achieves this object by mounting the inductive component outside of the periphery of the substrate. Mounting the inductive component outside the periphery of the substrate also permits the substrate to be smaller in size. Since the substrate is usually a printed circuit board or a ceramic substrate, mounting the inductive component outside the periphery of the substrate permits the substrate to be smaller, and therefore, decreases the cost of manufacturing the inductive component assembly of the present invention.

It is also an object of the present invention to provide an inductive component which increases the flux transfer of the magnetic core, thereby improving choke efficiency. The inductive component of the present invention achieves this object by providing the inductive component with a magnetic core having a central portion which is displaced off an edge of the magnetic core by a predetermined distance and by providing bevelled edges at a base of the central portion of the magnetic core.

It is also an object of the present invention to provide an inductive component which is more resistant to thermal expansion stress-related failures. The inductive component of the present invention achieves this object by providing the terminals of both the primary coil and the secondary coil close together on the same side of the inductive component.

It is also an objective of the present application to provide an inductive component with improved current carrying capacity. The inductive component of the present invention achieve this object by providing a primary coil with flat wiring and a magnetic core with bevelled edges.

BRIEF DESCRIPTION OF THE DRAWINGS

The present invention will become more fully understood from the detailed description hereinbelow in the accompanying drawings which are given by way of illustration only, and thus do not limit the present invention, wherein.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1A:
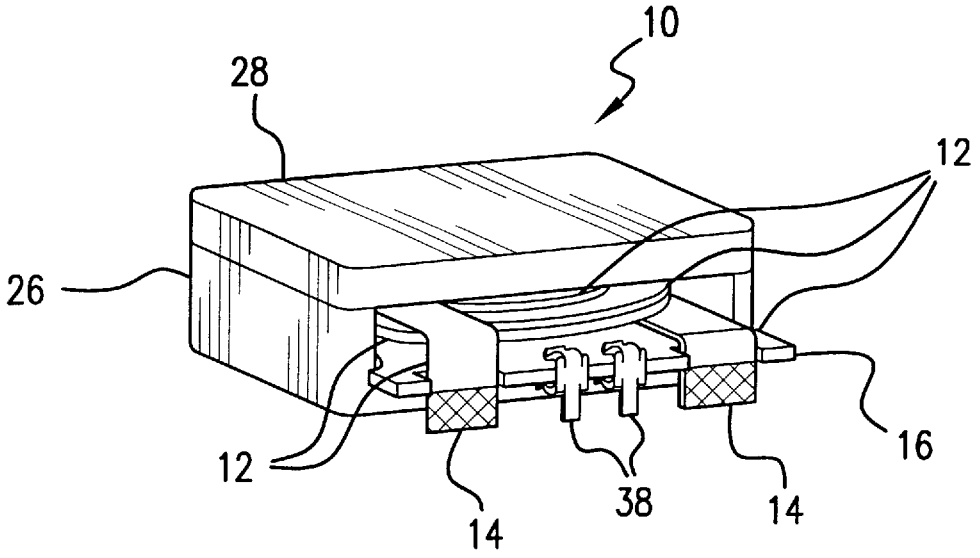
FIGS. 1(*a*) and 1(*b*) are perspective views illustrating the inductive component in one embodiment of the present invention.
Figure 1B:
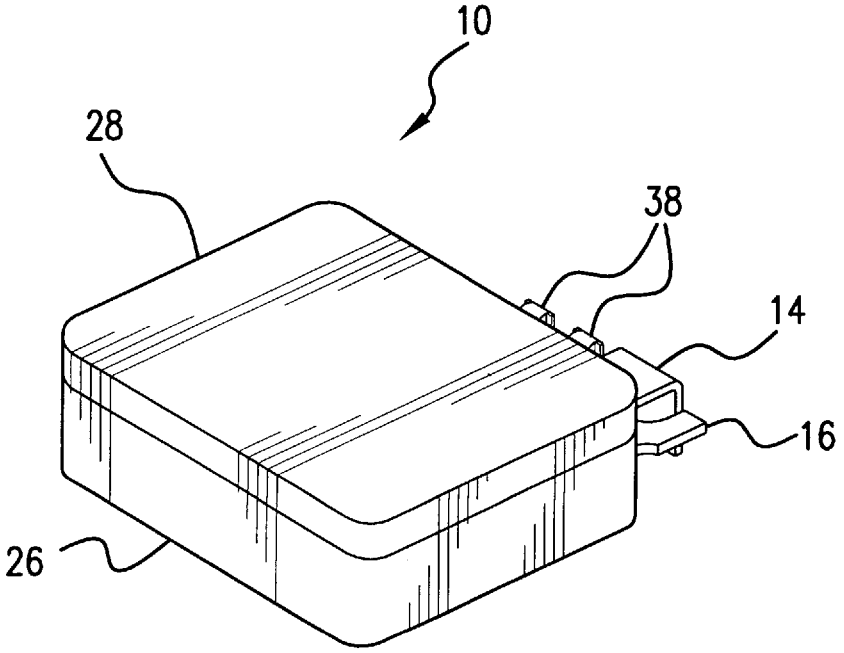
Figure 2:
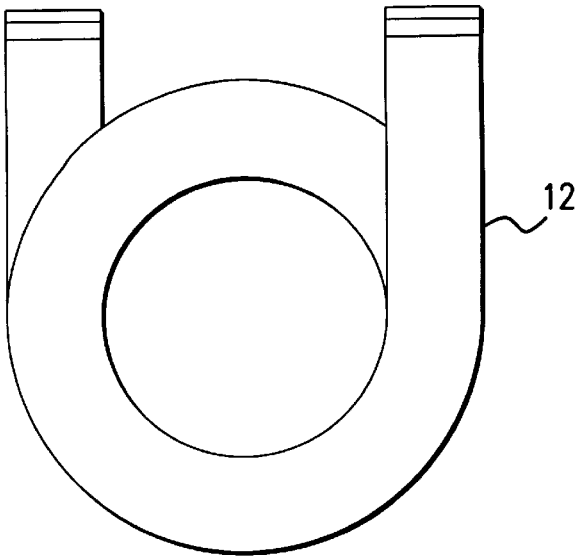
FIG. 2 is a plan view illustrating a flat wire primary coil of the inductive component.

FIGS. 1(*a*) and 1(*b*) illustrate an inductive component 10 in one embodiment of the present invention. The inductive component 10 includes a primary coil 12 having first and second terminals 14. The primary coil 12 is illustrated in more detail in FIG. 2. In a preferred embodiment, the primary coil 12 is a flat coil, which improves current carrying capacity.

Figure 3:
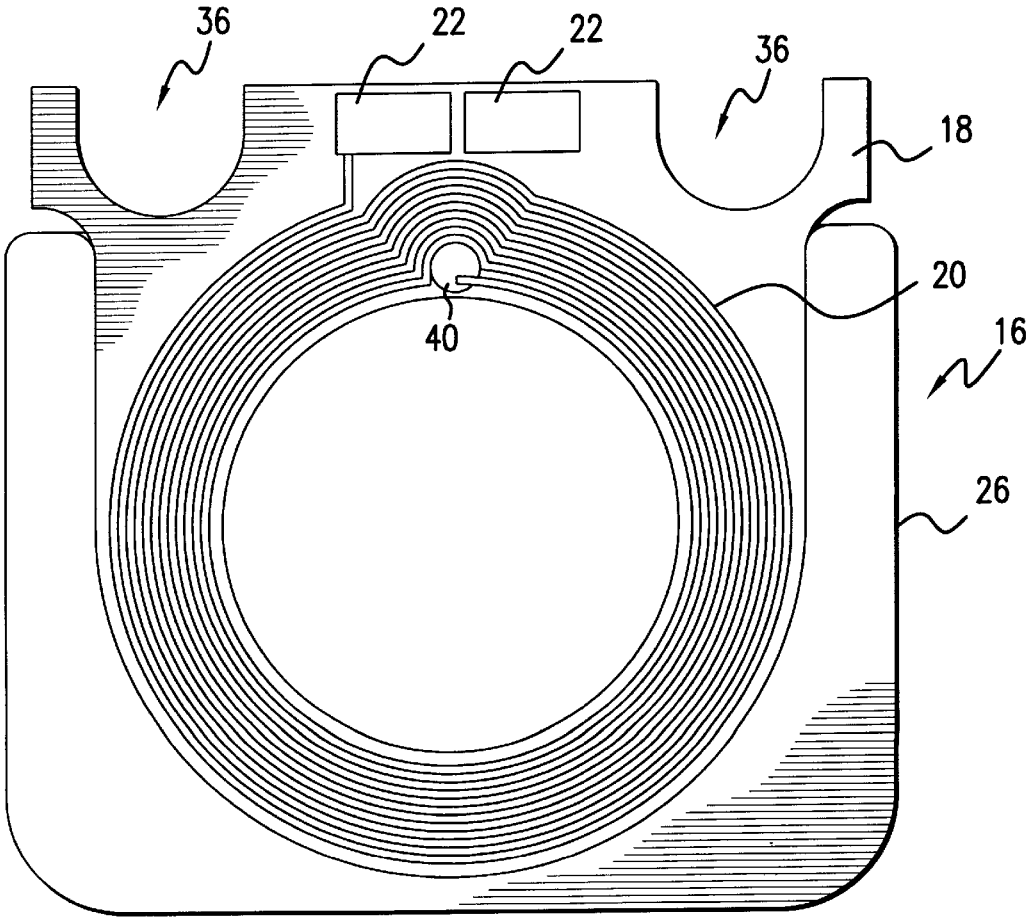
FIG. 3 illustrates a secondary coil in more detail in one embodiment of the present invention.

The inductive component 10 further includes a secondary coil 16, which is further illustrated in FIG. 3. The secondary coil 16 includes a coil substrate 18, wiring patterns 20, formed on each side of the coil substrate 18, and conductive terminals 22, which extend from one end of the coil substrate 18. The wiring patterns 20 are adhered to the coil substrate 18 and act as a sensing transformer coil. The wiring patterns 20 are much smaller than the wiring which makes up the primary coil 12. In a preferred embodiment, the coil substrate 18 is a printed circuit board.

FIG. 3 also illustrate two alignment recesses 36. These recesses 36 are utilized to align the first and second terminals 14 of the primary coil 12, keeping them stationary, especially when soldering, since soldering places substantial thermal stress and potential for distortion on the wiring of the primary coil 12.

Figure 4A:
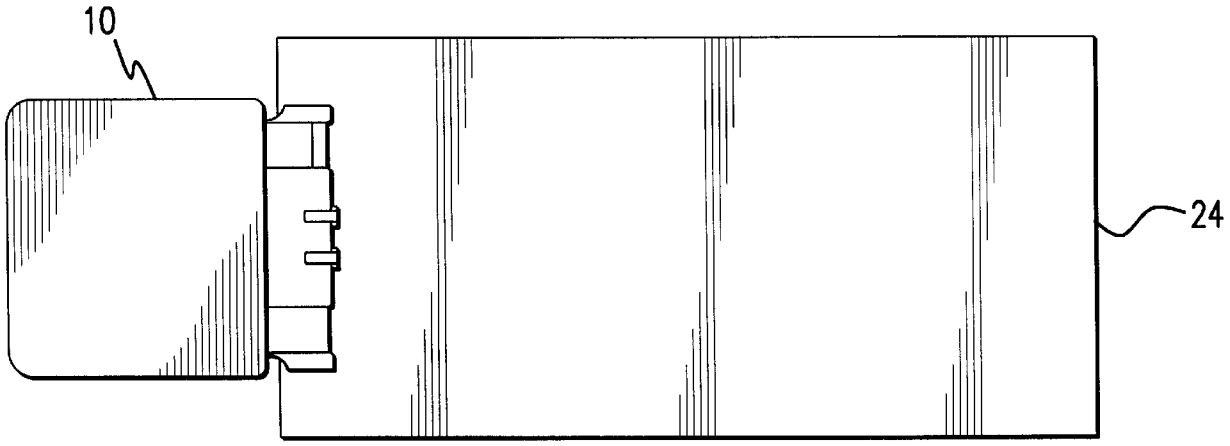
FIGS. 4(*a*) and 4(*b*) illustrate an inductive component assembly with an inductive component cantilevered off one end of a ceramic substrate, in one embodiment of the present invention.
Figure 4B:
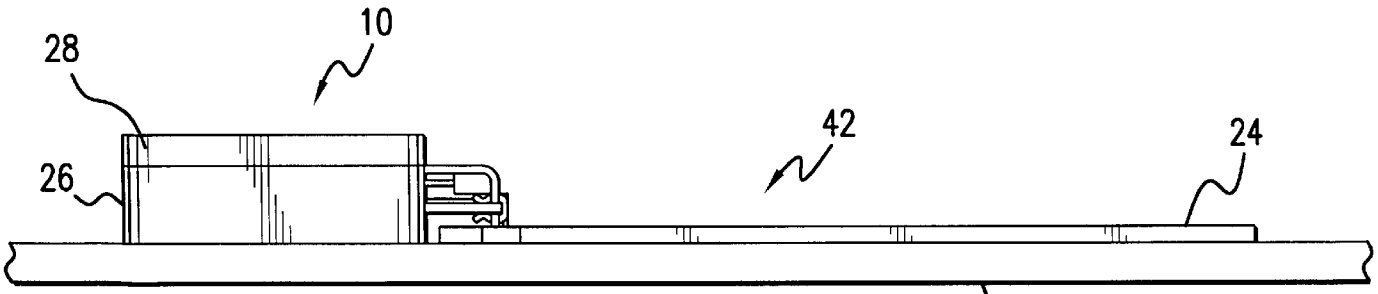

The first and second terminals 14, 22 of the primary coil 12 and the secondary coil 16 electrically connect the primary coil 12 and the wiring patterns 20 on the secondary coil 16, respectively, to other circuitry supported on a substrate 24. In a preferred embodiment, the substrate 24 is printed circuit board or a ceramic substrate. FIGS. 4(*a*) and 4(*b*) illustrate an inductive component assembly 42 with the inductive component 10 electrically connected to the substrate 24. FIG. 4(*b*) illustrates a support 30, which supports both the inductive component 10 and the substrate 24. In a preferred embodiment, the support 30 is made of aluminum or any conductive or non-conductive material. In a preferred embodiment, the support 30 is part of the housing or enclosure for the electronic device of which the inductive component is a part.

The inductive component 10 further includes a magnetic core 26 and a top portion 28, as illustrated in FIGS. 1(*a*) and 1(*b*). The magnetic core 26 and the top portion 28 are secured together, as illustrated in FIG. 1(*b*), with glue. The magnetic core 26 and the top portion 28 may also be secured with clips or tape.

Figure 5A:
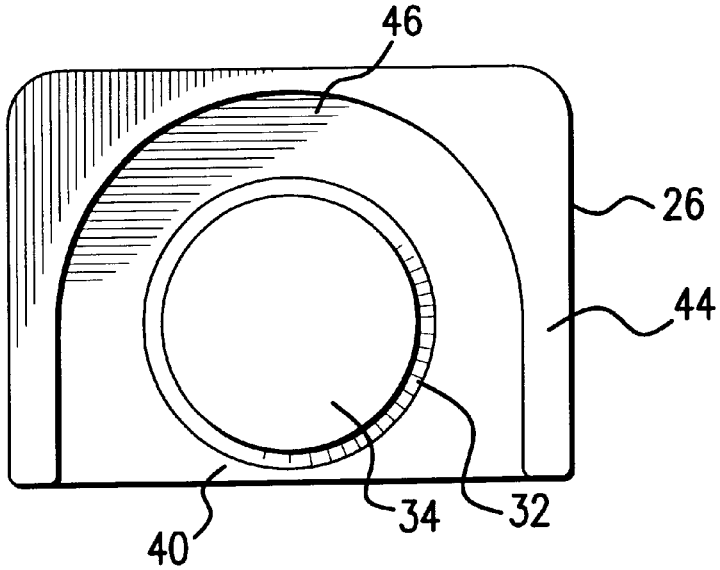
FIG. 5 illustrates the magnetic core in more detail, in one embodiment of the present invention.
Figure 5B:
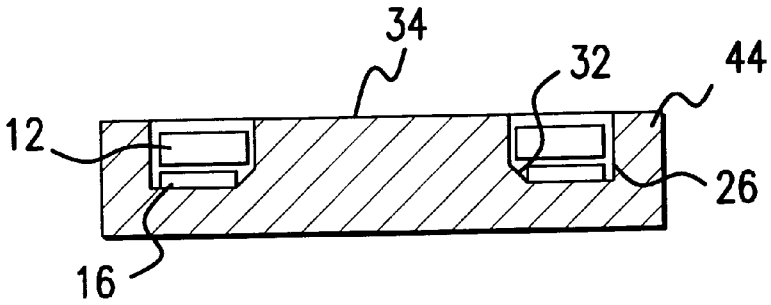

FIG. 5 illustrates a cross section view of the magnetic core 26 without the top surface 28. The magnetic core 26 includes a central portion 34 and an outer portion 44. The outer portion 44 conformably surrounds the primary coil 12 and the secondary coil 16. FIG. 5 illustrates that the central portion 34 of the magnetic core 26 is displaced off an edge of the magnetic core 26 by a distance 40. The magnetic core 26 is provided with an annular recess 46 surrounding the central portion 34 which receives the primary and secondary coils 12, 16. The magnetic core 26 has one edge which intersects the annular recess 46 to provide an opening to receive the first and second terminals 14 of the primary coil 12 and the conductive terminals 22 of the secondary coil 16. In a preferred embodiment, the distance 40 is also a distance sufficient to increase flux transfer. A bevelled edge 32 is provided at the base of the central portion 34 to increase the flux transfer of the magnetic core 26, thereby improving choke efficiency. The bevelled edge 32 forms a fillet at the base of the central portion 34.

This efficiency is accomplished without affecting the size of the primary coil 12 since the bevelled edges 32 only decrease the size of the winding pattern 20 of the secondary coil 16, which acts as a sensing coil to sense the current or voltage within the primary coil 12. As a result, the size of the primary coil 12 is not substantially degraded by the bevelled edges 32 while magnetic flux transfer is improved, thereby enhancing the performance of the primary coil 12. The secondary coil 16 provides feedback or a voltage supply to control circuitry. The winding pattern 20 of the secondary coil 16 makes the inductive component 10 a type of transformer.

As illustrated in FIGS. 4(*a*) and 4(*b*), in a preferred embodiment of the present invention, the inductive component 10 is mounted outside a periphery of the substrate 24. Mounting the inductive component or choke 10 outside the periphery of the substrate 24 increases thermal transfer between the inductive component 10 and the support 30, decreases the overall height of the assembly, and enables the entire assembly to be easily manufactured, which is an important objective in electronic circuitry, such as those used in a base station for a cellular telephone. In a preferred embodiment, the substrate 30 is thermally non-conductive.

Another reason to mount the inductive component or choke 10 outside the periphery of the substrate 24 is to avoid supporting the choke 10 with the substrate 24. Printed circuit boards or substrates are substantially more costly than a support and this substantially reduces the cost of the overall circuit.

Additionally, as illustrated in FIGS. 1(*a*), 1(*b*), 4(*a*) and 4(*b*), the primary coil 12 and the secondary coil 16 have their terminals 14, 22 exiting from the same side of the inductive component 10. By placing the terminals 14, 22 close together, this reduces stress due to different coefficients of thermal expansion between, for example, the primary and secondary coils 12, 16 and the substrate 24. As a result, the inductive component or choke 10 manufactured with terminals 14, 22 on one side is more resistant to thermal expansion stress-related failures than a choke coil having the terminals on opposite sides.

Springs or clips 38 are utilized to connect the secondary coil 16 to the substrate or printed circuit board 24. Both the primary coil 12 and the secondary coil 16 are electrically isolated from each other and from the magnetic core 26. The primary coil 12 has a 15–17 amp current load with a peak load possibility of 20 amps in the preferred embodiment.

Regarding the secondary coil 16, which acts a printed circuit sensing coil, the secondary coil 16 utilizes a standard throughhole 40 to transfer current from one side of the coil substrate 18 to the other, thereby making the secondary coil 16 two-layered. Although not required, there are some benefits to utilizing an identical mask for the first and second winding patterns 20 on either side of the coil substrate 18. One of these benefits is symmetry. Typically, in the manufacturing process, two masks are used, and they may be desirably, but not necessarily, identical.

In a preferred embodiment, the dimensions of the magnetic core 26 and the top portion 28 are on the order of 1 to 15 mm and the width of the winding of the primary coil 12 is on the order of several mm. The width of the winding of the secondary coil 16 is one to two orders of magnitude smaller than the winding of the primary coil 12. Finally, the diameter of each alignment recess 36 and the distance 40 are on the order of several mm.

In summary, the inductive component 10 of the present invention described above and illustrated in FIGS. 1–5, has an extremely flat profile, good heat transfer from the inductive component 10 to the support 30, has high current capacity, and is inexpensive and easy to manufacture.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. An inductive component, comprising:

a primary coil wound from a conductive material and having first and second terminals extending from one edge thereof at a first side of said inductive component for electrical connection to circuitry supported on a substrate;

a secondary coil including a coil substrate, wiring patterns formed on said coil substrate, an conductive terminals extending from one edge of said coil substrate at the first side of said inductive component and connecting said wiring patterns to the circuitry supported on the substrate; and a magnetic core for supporting said primary coil and said secondary coil in a magnetically coupled relationship;

said coil substrate being provided with alignment recesses receiving and locating said first and second terminals of said primary coil in a fixed relationship to each other and to said conductive terminals of said secondary coil.

2. The inductive component of claim 1, said magnetic core including a central portion, having a bevelled edge at a base thereof to increase flux transfer of said magnetic core.

3. The inductive component of claim 2, wherein the bevelled edge forms a fillet at a base of said central portion.

4. The induction component of claim 1, wherein the magnetic core is provided with an annular recess surrounding the central portion receiving said primary and secondary coils, said magnetic core having one edge thereof intersecting the recess to provide an opening to receive the first and second terminals of said primary coil and the conductive terminals of said secondary coil;

the distance between said one edge and said central portion being sufficient to increase flux transfer.

5. The inductive component of claim 1, wherein said primary coil is a flat coil.

6. The inductive component of claim 1, further comprising a top portion, wherein said magnetic core and said top portion substantially enclose said primary coil and said secondary coil.

7. The inductive component of claim 6, wherein said magnetic core and said top portion are glued, taped or clipped together.

8. The inductive component of claim 1, wherein said inductive component is mounted on the substrate.

9. The inductive component of claim 1, wherein said first and second terminals of said primary coil and said conductive terminals of said secondary coil are connected to circuitry supported on the substrate at substantially adjacent locations thereon to reduce thermal stress caused by differential thermal expansion of said primary and secondary coils and the substrate.

10. The inductive component of claim 1, wherein the substrate is at least one of a printed circuit board and a ceramic substrate.

11. The inductive component of claim 1, wherein said inductive component and the substrate are both mounted on a support.

12. The inductive component of claim 11, wherein said inductive component is mounted outside a periphery of the substrate to increase thermal transfer between said inductive component and the support.

13. The inductive component of claim 11, wherein the support is made of aluminum and is part of a housing for said inductive component.

14. The inductive component of claim 1, wherein said secondary coil acts as a sensing coil to sense a current or voltage within said primary coil.

15. The inductive component of claim 14, wherein said secondary coil provides feedback to control operation of a circuit connected to said primary coil.

16. The inductive component of claim 1, wherein said inductive component is part of a power supply.

17. The inductive component of claim 16, wherein the power supply is part of a base station for a cellular telephone.

18. The inductive component of claim 1 wherein said inductive component is part of a inductive component assembly further comprising:

a substrate; and a support supporting both said substrate and said inductive component with said inductive component being mounted outside a periphery of said substrate to reduce an overall thickness of said inductive component assembly.

19. The inductive component of claim 18, wherein said inductive component is mounted directly on said support.

20. The inductive component of claim 19, wherein mounting said inductive component on said support increases thermal transfer between said inductive component and said support.

21. The inductive component of claim 20, said first and second primary coil terminals being connected to circuitry on said substrate at substantially adjacent locations thereon to reduce thermal stress caused by differential thermal expansion of said primary and secondary coils and said substrate.

* * * * *